US011332682B2

(12) United States Patent
Filip

(10) Patent No.: US 11,332,682 B2
(45) Date of Patent: May 17, 2022

(54) METHODS FOR REDUCING OXIDATION

(71) Applicant: BP OIL INTERNATIONAL LIMITED, Middlesex (GB)

(72) Inventor: Sorin Vasile Filip, Middlesex (GB)

(73) Assignee: BP OIL INTERNATIONAL LIMITED, Sunbury On Thames (GB)

( * ) Notice: Subject to any disclaimer, the term of this patent is extended or adjusted under 35 U.S.C. 154(b) by 0 days.

(21) Appl. No.: 16/639,538

(22) PCT Filed: Aug. 13, 2018

(86) PCT No.: PCT/EP2018/071873
§ 371 (c)(1),
(2) Date: Feb. 14, 2020

(87) PCT Pub. No.: WO2019/034581
PCT Pub. Date: Feb. 21, 2019

(65) Prior Publication Data

US 2021/0139800 A1 May 13, 2021

(30) Foreign Application Priority Data

Aug. 14, 2017 (GB) ..... 1713009

(51) Int. Cl.
*C10L 1/233* (2006.01)
*C10L 10/10* (2006.01)
(Continued)

(52) U.S. Cl.
CPC ..... *C10L 1/233* (2013.01); *C10L 10/10* (2013.01); *C10M 133/38* (2013.01);
(Continued)

(58) Field of Classification Search
CPC .... C10L 1/233; C10L 10/10; C10L 2270/023; C10L 2200/0423; C10M 133/38;
(Continued)

(56) References Cited

U.S. PATENT DOCUMENTS 1,833,429 A 11/1931 Lovell et al.
4,304,712 A 12/1981 Lai
(Continued)

FOREIGN PATENT DOCUMENTS

EP 0444807 A1 2/1991
KR 2012102381 * 9/2012
(Continued)

OTHER PUBLICATIONS

The International Search Report (ISR) with Written Opinion for PCT/EP2018/071873 dated Oct. 31, 2018, pp. 1-11.
(Continued)

*Primary Examiner* — Cephia D Toomer
(74) *Attorney, Agent, or Firm* — McDonnell Boehnen Hulbert & Berghoff LLP

(57) ABSTRACT

A method for reducing the tendency of a hydrocarbon fluid to oxidise comprises combining an additive having a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon with the hydrocarbon fluid. The additive may also be used for protecting a system in which a hydrocarbon fluid is used from the effects of oxidation.

23 Claims, 4 Drawing Sheets

(51) Int. Cl.
*C10M 133/40* (2006.01)
*C10M 133/38* (2006.01)

(52) U.S. Cl.
CPC ... *C10M 133/40* (2013.01); *C10L 2200/0423* (2013.01); *C10L 2270/023* (2013.01); *C10M 2215/22* (2013.01); *C10M 2215/221* (2013.01); *C10M 2215/225* (2013.01); *C10M 2215/30* (2013.01)

(58) Field of Classification Search
CPC ..... C10M 133/40; C10M 2215/22; C10M 2215/30; C10M 2215/221; C10M 2215/225
See application file for complete search history.

(56) References Cited

U.S. PATENT DOCUMENTS

| | | | | |
|---|---|---|---|---|
| H2135 | H | 12/2005 | Brundage et al. | |
| 9,062,267 | B2 * | 6/2015 | Lange | C10L 1/16 |
| 10,604,713 | B2 * | 3/2020 | Filip | C10L 10/10 |
| 10,738,252 | B2 * | 8/2020 | Filip | C10L 10/10 |
| 2006/0196107 | A1 | 9/2006 | Malfer et al. | |

FOREIGN PATENT DOCUMENTS

| | | | |
|---|---|---|---|
| KR | 20120102381 | A | 9/2012 |
| WO | 2006094210 | A2 | 9/2006 |
| WO | 2007/012580 | A1 | 2/2007 |
| WO | 2017/137513 | A1 | 8/2017 |
| WO | 2017/137514 | A1 | 8/2017 |
| WO | 2017/137516 | A1 | 8/2017 |
| WO | 2017/137518 | A1 | 8/2017 |
| WO | 2017/137519 | A1 | 8/2017 |
| WO | 2017/137521 | A1 | 8/2017 |

OTHER PUBLICATIONS

Search Report under Section 17(5) for G131713009.7 dated Feb. 9, 2018, pp. 1-4.

* cited by examiner

METHODS FOR REDUCING OXIDATION

This application is a national stage application under 35 U.S.C. § 371 of International Application No. PCT/EP2018/071873, filed Aug. 13, 2018, which claims priority to Great Britain Patent Application No. GB 1713009.7, filed Aug. 14, 2017, the disclosures of which are explicitly incorporated by reference herein.

FIELD OF THE INVENTION

This invention relates to methods for improving the characteristics of hydrocarbon fluids. In particular, the invention relates to additives for use in methods for reducing the tendency of hydrocarbon fluids, such as fuels and lubricants that are used in an internal combustion engine, to oxidise. Also provided is the use of the additives as anti-oxidants.

BACKGROUND OF THE INVENTION

Internal combustion engines are widely used for power, both domestically and in industry. For instance, internal combustion engines are commonly used to power vehicles, such as passenger cars, in the automotive industry.

Fuels and lubricants are hydrocarbon fluids that are used in internal combustion engines. Under certain conditions encountered during the storage, transportation or use of hydrocarbon fluids, free-radicals may be generated. These free-radicals lead to oxidation of the hydrocarbon fluid.

One mechanism by which free-radicals may be generated is from oxygen that has dissolved in the hydrocarbon fluid as a result of surface contact with air, e.g. during refining, storage or transportation of the fluid. On exposure to UV light, the oxygen may be oxidised, thereby generating free-radicals. The heat encountered during combustion in an engine can also contribute to the production of free-radicals in a hydrocarbon fluid.

The performance of an engine can be significantly impeded by oxidation of the hydrocarbon fluids that are used in the engine. This is because, once free-radicals are formed, they can react with unsaturated hydrocarbon substances such as olefins that are present in the hydrocarbon fluids, leading to polymerisation. The resulting polymers are often insoluble, and may deposit on engine surfaces. Once deposited, the residues may impede the movement of engine parts, block filters and inlet/outlet ports (such as fuel injectors and air injectors), reduce thermal transfer and thicken the engine lubricant.

In order to reduce oxidation, anti-oxidant additives are typically added to hydrocarbon fluids. Anti-oxidants are intended to minimise and delay the onset of oxidation in a hydrocarbon fluid. This can be achieved in a number of ways, one of which is free-radical quenching.

Aromatic amines and hindered phenols have previously been used as anti-oxidants. Since these compounds may exist in a stable radical form, they can act as free-radical scavengers thereby breaking radical chain reactions which occur in hydrocarbon fluids (see e.g. Lubricant Additives: Chemistry and Applications, 2nd edition, 2009, Leslie R. Rudnick).

WO 2007/012580 discloses tetrahydrobenzoxazines as stabilisers for the stabilisation of inanimate organic materials, in particular turbine fuels, against the effects of light, acid and heat.

GB 2 308 849 discloses dihydro benzoxazine derivatives for use as anti-knock agents.

There remains a need for further additives that are able to reduce oxidation in hydrocarbon fluids, such as fuels and lubricants for an internal combustion engine.

SUMMARY OF THE INVENTION

Surprisingly, it has now been found that an additive having a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon, provides a substantial effect as an anti-oxidant in a hydrocarbon fluid which is used in an internal combustion engine.

Accordingly, the present invention provides a method for reducing the tendency of a hydrocarbon fluid to oxidise, said method comprising combining an additive having a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon with the hydrocarbon fluid.

The present invention further provides a method for protecting a system in which a hydrocarbon fluid is used from the effects of oxidation, said method comprising combining an anti-oxidant additive described herein with the hydrocarbon fluid.

Also provided is the use of an anti-oxidant additive described herein as an anti-oxidant in a hydrocarbon fluid, as well as the use of an anti-oxidant additive described herein for protecting a system in which a hydrocarbon fluid is used from the effects of oxidation.

BRIEF DESCRIPTION OF THE FIGURES

FIG. 1*a* shows a graph of the change in octane number of an E0 fuel having a RON prior to additisation of 90; FIG. 1*b* shows a graph of the change in octane number of an E0 fuel having a RON prior to additisation of 95; and FIG. 1*c* shows a graph of the change in octane number of an E10 fuel having a RON prior to additisation of 95.

FIG. 2*a* shows a graph of the change in octane number of an E0 and an E10 fuel against treat rate; FIG. 2*b* shows a graph of the change in octane number of an E0 fuel at a treat rate of 0.67% w/w; and FIG. 2*c* shows a graph of the change in octane number of an E10 fuel at a treat rate of 0.67% w/w.

DETAILED DESCRIPTION OF THE INVENTION

Anti-Oxidant Additive

Figure 1A:
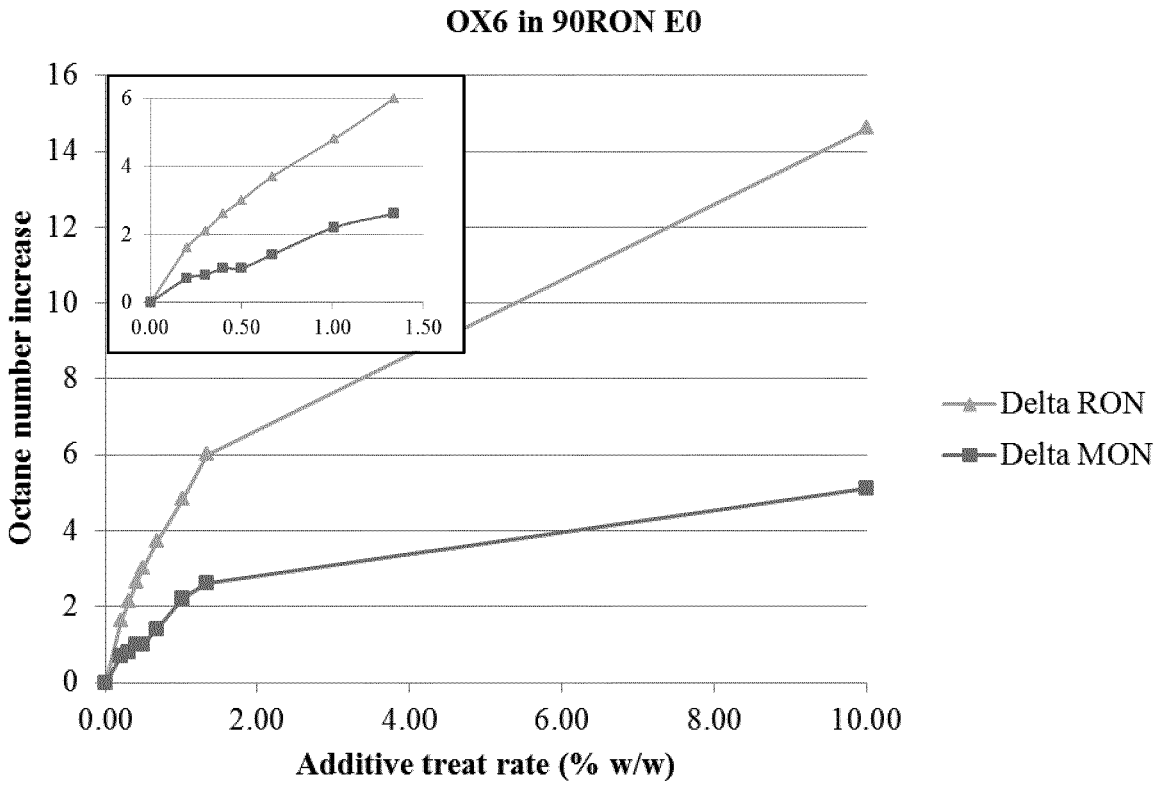
FIGS. 1*a-c* show graphs of the change in octane number (both RON and MON) of fuels when treated with varying amounts of an anti-oxidant additive described herein. Specifically.

The present invention provides methods and uses in which an additive is used to reduce oxidation in a hydrocarbon fluid, such as in a fuel or lubricant.

The anti-oxidant additive has a chemical structure comprising a 6-membered aromatic ring sharing two adjacent aromatic carbon atoms with a 6- or 7-membered otherwise saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon (referred to in short as an anti-oxidant additive described herein). As will be appreciated, the 6- or 7-membered heterocyclic ring sharing two adjacent aromatic carbon atoms with the 6-membered aromatic ring may be considered saturated but for those two shared carbon atoms, and may thus be termed "otherwise saturated."

Alternatively stated, the anti-oxidant additive used in the present invention may be a substituted or unsubstituted 3,4-dihydro-2H-benzo[b][1,4]oxazine (also known as benzomorpholine), or a substituted or unsubstituted 2,3,4,5-tetrahydro-1,5-benzoxazepine. In other words, the additive may be 3,4-dihydro-2H-benzo[b][1,4]oxazine or a derivative thereof, or 2,3,4,5-tetrahydro-1,5-benzoxazepine or a derivative thereof. Accordingly, the additive may comprise one or more substituents and is not particularly limited in relation to the number or identity of such substituents.

Preferred additives have the following formula:

(a)

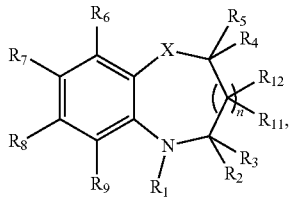

(b)

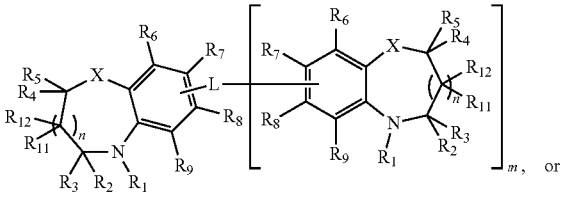

(c)

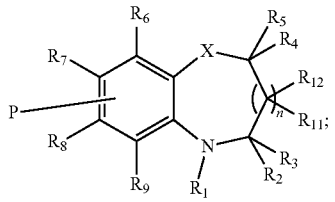

where: $R_1$ is hydrogen;

$R_2$, $R_3$, $R_4$, $R_5$, $R_1$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups;

n is 0 or 1;

L is a linking group;

m is 1, 2 or 3; and

P is a polymer-containing group or a group derived from a fatty acid.

It will be understood that, where the additive has formula (b) or (c), one of $R_6$, $R_7$, $R_8$ and $R_9$ on each 6-membered aromatic ring is substituted with the linking group L or the polymer-containing group P, respectively.

In some embodiments, $R_2$, $R_3$, $R_4$, $R_5$, $R_{11}$ and $R_{12}$ are each independently selected from hydrogen and alkyl groups, and preferably from hydrogen, methyl, ethyl, propyl and butyl groups. More preferably, $R_2$, $R_3$, $R_4$, $R_5$, $R_{11}$ and $R_{12}$ are each independently selected from hydrogen, methyl and ethyl, and even more preferably from hydrogen and methyl.

In some embodiments, $R_6$, $R_7$, $R_8$ and $R_9$ are each independently selected from hydrogen, alkyl and alkoxy groups, and preferably from hydrogen, methyl, ethyl, propyl, butyl, methoxy, ethoxy and propoxy groups. More preferably, $R_6$, $R_7$, $R_8$ and $R_9$ are each independently selected from hydrogen, methyl, ethyl and methoxy, and even more preferably from hydrogen, methyl and methoxy.

Advantageously, at least one of $R_2$, $R_3$, $R_4$, $R_5$, $R_6$, $R_7$, $R_8$, $R_9$, $R_{11}$ and $R_{12}$, and preferably at least one of $R_6$, $R_7$, $R_8$ and $R_9$, is selected from a group other than hydrogen. More preferably, at least one of $R_7$ and $R_8$ is selected from a group other than hydrogen. Alternatively stated, the anti-oxidant additive may be substituted in at least one of the positions represented by $R_2$, $R_3$, $R_4$, $R_5$, $R_6$, $R_7$, $R_8$, $R_9$, $R_{11}$ and $R_{12}$, preferably in at least one of the positions represented by $R_6$, $R_7$, $R_8$ and $R_9$, and more preferably in at least one of the positions represented by $R_7$ and $R_8$. It is believed that the presence of at least one group other than hydrogen may improve the solubility of the anti-oxidant additives in a fuel.

Also advantageously, no more than five, preferably no more than three, and more preferably no more than two, of $R_2$, $R_3$, $R_4$, $R_5$, $R_6$, $R_7$, $R_8$, $R_9$, $R_{11}$ and $R_{12}$ are selected from a group other than hydrogen. Preferably, one or two of $R_2$, $R_3$, $R_4$, $R_5$, $R_6$, $R_7$, $R_8$, $R_9$, $R_{11}$ and $R_{12}$ are selected from a group other than hydrogen. In some embodiments, only one of $R_2$, $R_3$, $R_4$, $R_5$, $R_6$, $R_7$, $R_8$, $R_9$, $R_{11}$ and $R_{12}$ is selected from a group other than hydrogen.

It is also preferred that at least one of $R_2$ and $R_3$ is hydrogen, and more preferred that both of $R_2$ and $R_3$ are hydrogen.

In preferred embodiments, at least one of $R_4$, $R_5$, $R_7$ and $R_8$ is selected from methyl, ethyl, propyl and butyl groups and the remainder of $R_2$, $R_3$, $R_4$, $R_5$, $R_6$, $R_7$, $R_8$, $R_9$, $R_{11}$ and $R_{12}$ are hydrogen. More preferably, at least one of $R_7$ and $R_8$ are selected from methyl, ethyl, propyl and butyl groups and the remainder of $R_2$, $R_3$, $R_4$, $R_5$, $R_6$, $R_7$, $R_8$, $R_9$, $R_{11}$ and $R_{12}$ are hydrogen.

In further preferred embodiments, at least one of $R_4$, $R_5$, $R_7$ and $R_8$ is a methyl group and the remainder of $R_2$, $R_3$, $R_4$, $R_5$, $R_6$, $R_7$, $R_8$, $R_9$, $R_{11}$ and $R_{12}$ are hydrogen. More preferably, at least one of $R_7$ and $R_8$ is a methyl group and the remainder of $R_2$, $R_3$, $R_4$, $R_5$, $R_6$, $R_7$, $R_8$, $R_9$, $R_{11}$ and $R_{12}$ are hydrogen.

Preferably, X is —O— or —$NR_{10}$—, where $R_{10}$ is selected from hydrogen, methyl, ethyl, propyl and butyl groups, and preferably from hydrogen, methyl and ethyl groups. More preferably, $R_{10}$ is hydrogen. In preferred embodiments, X is —O—.

n may be 0 or 1, though it is preferred that n is 0.

Preferred anti-oxidants have the formula:

(a)

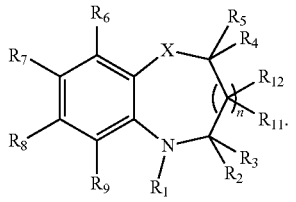

Other anti-oxidants have the formula:

(b)

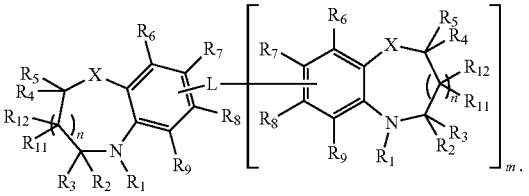

In these cases, m is preferably 1, and so the additive is in a dimeric form.

The linking group, L, in dimer additives is preferably selected from $—R_{13}—$, $—O—R_{13}—O—$, $—O—(R_{14}O)_p—$ and $—OC(O)—R_{13}—C(O)O—$.

$R_{13}$ is selected from alkanediyl and alkenediyl groups, preferably from $C_{1-30}$ alkanediyl and $C_{1-30}$ alkenediyl groups, more preferably from $C_{1-30}$ alkanediyl groups, and still more preferably from $C_{1-15}$ alkanediyl groups.

$R_{14}$ is selected from alkanediyl groups, preferably from $C_{1-10}$ alkanediyl groups, more preferably from $C_{1-5}$ alkanediyl groups, and still more preferably from $C_{2-4}$ alkanediyl groups; and p is from 1 to 30, and preferably from 12 to 22.

m may also be 2 or 3, in which case the additive is in a trimeric or tetrameric form, respectively.

In these instances, L is preferably selected from $—O—R_{15}—CH_{3-m}(R_{15}—O—)_m$ and $—OC(O)—R_{15}—CH_{3-m}(R_{15}—C(O)O—)_m$.

$R_{15}$ is selected from alkanediyl and alkenediyl groups, preferably from $C_{1-10}$ alkanediyl and $C_{1-10}$ alkenediyl groups, more preferably from $C_{1-10}$ alkanediyl groups, and still more preferably from $C_{1-5}$ alkanediyl groups.

Other anti-oxidants have the formula:

(c)

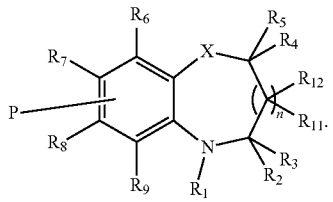

In some embodiments, P is a polymer-containing group having the structure:

-A-B-C.

In these embodiments, A may be present or absent, and is selected from —O—, $—OR_{16}—$ and $—R_{16}—$.

$R_{16}$ is selected from alkanediyl and alkenediyl groups, preferably from $C_{1-10}$ alkanediyl and $C_{1-10}$ alkenediyl groups, more preferably from $C_{1-10}$ alkanediyl groups, and still more preferably from $C_{1-5}$ alkanediyl groups.

B is a polymer, preferably a polyolefin or a polyether, more preferably a polyolefin or polyether in which the monomer units contain from 1-10 carbon atoms and preferably from 1-5 carbon atoms.

Preferably, B is a polymer which contains from 5 to 2000 monomer units, more preferably from 8 to 500 monomer units, and still more preferably from 10 to 20 monomer units.

C is selected from alkyl and alkoxy groups, preferably from $C_{1-20}$ alkyl and $C_{1-20}$ alkoxy groups, more preferably from $C_{1-10}$ alkyl groups, and still more preferably from $C_{1-5}$ alkyl groups.

In other embodiments, P is a group derived from a fatty acid having the structure $—OC(O)—R_{15}$, where $R_{15}$ is a $C_{1-26}$ hydrocarbon chain. $R_{15}$ may be a saturated or unsaturated hydrocarbon chain.

Anti-oxidant additives that may be used in the present invention include:

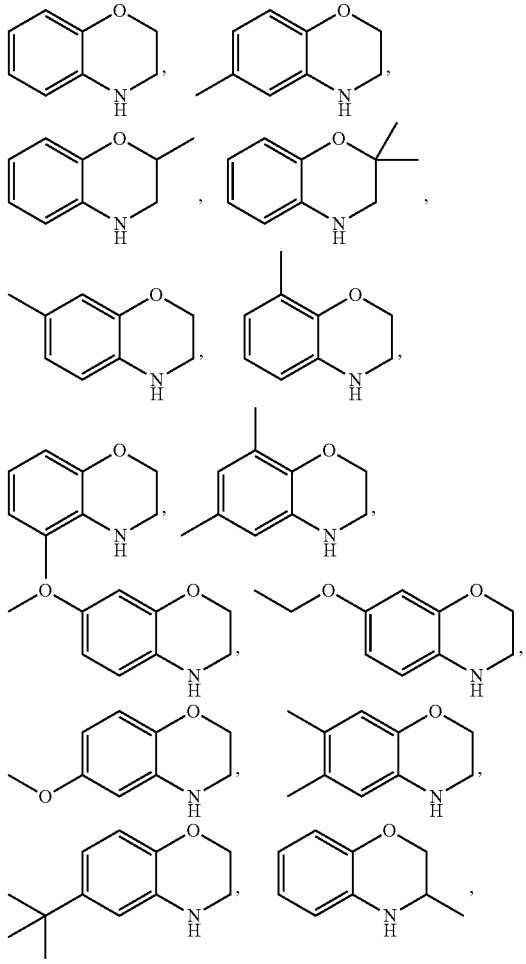

-continued

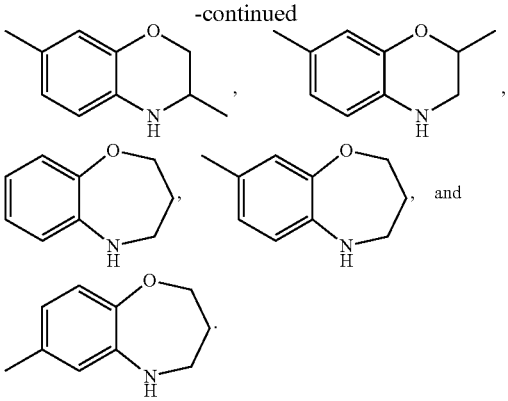

Preferred anti-oxidant additives include:

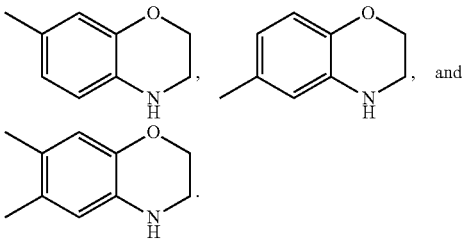

A mixture of additives may be used in the hydrocarbon fluids. For instance, the hydrocarbon fluids may comprise a mixture of:

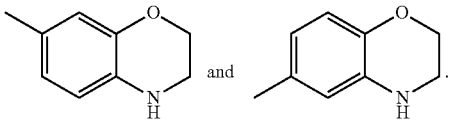

It will be appreciated that references to alkyl groups include different isomers of the alkyl group, i.e. straight chain and branched groups. For instance, references to propyl groups embrace n-propyl and i-propyl groups, and references to butyl embrace n-butyl, isobutyl, sec-butyl and tert-butyl groups.

Hydrocarbon Fluid

The anti-oxidant additives described herein are used to reduce oxidation in a hydrocarbon fluid. The hydrocarbon fluid is preferably a fuel, though it may also be a lubricant.

The fuel is preferably for an internal combustion engine, such as a spark-ignition internal combustion engine or a compression-ignition internal combustion engine. The fuel may also be an aviation fuel, such as jet fuel, or a marine (bunker) fuel.

The anti-oxidant additives disclosed herein may be combined with the hydrocarbon fluid to form a hydrocarbon fluid composition.

The hydrocarbon fluid composition may comprise a major amount (i.e. greater than 50% by weight) of liquid hydrocarbon ("base hydrocarbon") and a minor amount (i.e. less than 50% by weight) of anti-oxidant additive described herein, i.e. an additive having a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon.

Hydrocarbon fluid compositions may be produced by a process which comprises combining, in one or more steps, a hydrocarbon fluid with an anti-oxidant additive described herein. In embodiments in which the hydrocarbon fluid composition comprises one or more further additives, the further fuel additives may also be combined, in one or more steps, with the hydrocarbon fluid.

In some embodiments, the anti-oxidant additive may be combined with the hydrocarbon fluid in the form of a refinery additive composition or as a marketing additive composition. Thus, the anti-oxidant additive may be combined with one or more other components (e.g. additives and/or solvents) of the hydrocarbon fluid composition as a marketing additive, e.g. at a terminal or distribution point. The anti-oxidant additive may also be added on its own at a terminal or distribution point. The anti-oxidant additive may also be combined with one or more other components (e.g. additives and/or solvents) of the hydrocarbon composition for sale in a bottle, e.g. for addition to hydrocarbon fluid at a later time.

The anti-oxidant additive and any other additives of the hydrocarbon fluid composition may be incorporated into the composition as one or more additive concentrates and/or additive part packs, optionally comprising solvent or diluent.

Fuels for Spark-Ignition Internal Combustion Engines

In preferred embodiments, the anti-oxidant additives are used as anti-oxidants in a fuel composition for a spark-ignition internal combustion engine. Gasoline fuels (including those containing oxygenates) are typically used in spark-ignition internal combustion engines. Commensurately, the anti-oxidant additives may be used in a gasoline fuel composition.

Examples of suitable liquid fuels include hydrocarbon fuels, oxygenate fuels and combinations thereof.

Hydrocarbon fuels that may be used in a spark-ignition internal combustion engine may be derived from mineral sources and/or from renewable sources such as biomass (e.g. biomass-to-liquid sources) and/or from gas-to-liquid sources and/or from coal-to-liquid sources.

Oxygenate fuels that may be used in a spark-ignition internal combustion engine contain oxygenate fuel components, such as alcohols and ethers. Suitable alcohols include straight and/or branched chain alkyl alcohols having from 1 to 6 carbon atoms, e.g. methanol, ethanol, n-propanol, n-butanol, isobutanol, tert-butanol. Preferred alcohols include methanol and ethanol. Suitable ethers include ethers having 5 or more carbon atoms, e.g. methyl tert-butyl ether and ethyl tert-butyl ether.

In some preferred embodiments, the fuel composition comprises ethanol, e.g. ethanol complying with EN 15376: 2014. The fuel composition may comprise ethanol in an amount of up to 85%, preferably from 1% to 30%, more preferably from 3% to 20%, and even more preferably from 5% to 15%, by volume. For instance, the fuel may contain ethanol in an amount of about 5% by volume (i.e. an E5 fuel), about 10% by volume (i.e. an E10 fuel) or about 15% by volume (i.e. an E15 fuel). A fuel which is free from ethanol is referred to as an E0 fuel.

Ethanol is believed to improve the solubility of the anti-oxidant additives described herein in the fuel. Thus, in some embodiments, for instance where the anti-oxidant additive is unsubstituted (e.g. an additive in which $R_1$, $R_2$, $R_3$, $R_4$, $R_5$, $R_6$, $R_7$, $R_8$ and $R_9$ are hydrogen; X is —O—; and n is 0) it may be preferable to use the additive with a fuel which comprises ethanol.

The fuel composition may meet particular automotive industry standards. For instance, the fuel composition may have a maximum oxygen content of 2.7% by mass.

The fuel composition may have maximum amounts of oxygenates as specified in EN 228, e.g. methanol: 3.0% by volume, ethanol: 5.0% by volume, iso-propanol: 10.0% by volume, iso-butyl alcohol: 10.0% by volume, tert-butanol: 7.0% by volume, ethers (e.g. having 5 or more carbon atoms): 10% by volume and other oxygenates (subject to suitable final boiling point): 10.0% by volume.

The fuel composition may have a sulfur content of up to 50.0 ppm by weight, e.g. up to 10.0 ppm by weight.

Examples of suitable fuel compositions include leaded and unleaded fuel compositions. Preferred fuel compositions are unleaded fuel compositions.

In embodiments, the fuel composition meets the requirements of EN 228, e.g. as set out in BS EN 228:2012. In other embodiments, the fuel composition meets the requirements of ASTM D 4814, e.g. as set out in ASTM D 4814-15a. It will be appreciated that the fuel compositions may meet both requirements, and/or other fuel standards.

The fuel composition for a spark-ignition internal combustion engine may exhibit one or more (such as all) of the following, e.g., as defined according to BS EN 228:2012: a minimum research octane number of 95.0, a minimum motor octane number of 85.0 a maximum lead content of 5.0 mg/1, a density of 720.0 to 775.0 kg/$m^3$, an oxidation stability of at least 360 minutes, a maximum existent gum content (solvent washed) of 5 mg/100 ml, a class 1 copper strip corrosion (3 h at 50° C.), clear and bright appearance, a maximum olefin content of 18.0% by weight, a maximum aromatics content of 35.0% by weight, and a maximum benzene content of 1.00% by volume.

As explained in greater detail below, the anti-oxidant additives described herein may advantageously be used as a multi-purpose fuel additive since they also act as octane improvers.

The anti-oxidant additives described herein may be combined with the fuel in an amount of up to 20%, preferably from 0.1% to 10%, and more preferably from 0.2% to 5% weight additive/weight base fuel. Even more preferably, the fuel composition contains the anti-oxidant additive in an amount of from 0.25% to 2%, and even more preferably still from 0.3% to 1% weight additive/weight base fuel. These amounts are particularly suitable when the anti-oxidant additive is used as a multi-purpose fuel additive.

Alternatively, the anti-oxidant control additives described herein may be combined with the fuel in an amount of up to 1%, preferably from 0.0001% to 0.5%, more preferably from 0.0005% to 0.3%, even more preferably from 0.0008% to 0.2%, and even more preferably still from 0.001% to 0.1%, weight additive/weight base fuel. These amounts are particularly suitable when the additive is used primarily as an anti-oxidant, though octane number improvements may also be observed at these levels.

It will be appreciated that, when more than one anti-oxidant additive described herein is used, these values refer to the total amount of anti-oxidant additive described herein in the fuel.

The fuel compositions may comprise at least one other further fuel additive.

Examples of such other additives that may be present in the fuel compositions include detergents, friction modifiers/anti-wear additives, corrosion inhibitors, combustion modifiers, octane improvers, valve seat recession additives, dehazers/demulsifiers, dyes, markers, odorants, anti-static agents, anti-microbial agents, and lubricity improvers.

Further anti-oxidants may also be used in the fuel composition, i.e. anti-oxidants which are not anti-oxidant additives described herein, i.e. they do not have a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon.

Examples of suitable detergents include polyisobutylene amines (PIB amines) and polyether amines.

Examples of suitable friction modifiers and anti-wear additives include those that are ash-producing additives or ashless additives. Examples of friction modifiers and anti-wear additives include esters (e.g. glycerol mono-oleate) and fatty acids (e.g. oleic acid and stearic acid).

Examples of suitable corrosion inhibitors include ammonium salts of organic carboxylic acids, amines and heterocyclic aromatics, e.g. alkylamines, imidazolines and tolyltriazoles.

Examples of suitable further anti-oxidants include phenolic anti-oxidants (e.g. 2,4-di-tert-butylphenol and 3,5-di-tert-butyl-4-hydroxyphenylpropionic acid) and aminic anti-oxidants (e.g. para-phenylenediamine, dicyclohexylamine and derivatives thereof).

Examples of suitable valve seat recession additives include inorganic salts of potassium or phosphorus.

Examples of suitable octane improvers include non-metallic octane improvers include N-methyl aniline and nitrogen-based ashless octane improvers. Metal-containing octane improvers, including methylcyclopentadienyl manganese tricarbonyl, ferrocene and tetra-ethyl lead, may also be used. However, in preferred embodiments, the fuel composition is free of all added metallic octane improvers including methyl cyclopentadienyl manganese tricarbonyl and other metallic octane improvers including e.g. ferrocene and tetraethyl lead.

Examples of suitable dehazers/demulsifiers include phenolic resins, esters, polyamines, sulfonates or alcohols which are grafted onto polyethylene or polypropylene glycols.

Examples of suitable markers and dyes include azo or anthraquinone derivatives.

Examples of suitable anti-static agents include fuel soluble chromium metals, polymeric sulfur and nitrogen compounds, quaternary ammonium salts or complex organic alcohols. However, the fuel composition is preferably substantially free from all polymeric sulfur and all metallic additives, including chromium based compounds.

In some embodiments, the fuel composition comprises solvent, e.g. which has been used to ensure that the additives are in a form in which they can be stored or combined with the liquid fuel. Examples of suitable solvents include polyethers and aromatic and/or aliphatic hydrocarbons, e.g. heavy naphtha e.g. Solvesso (Trade mark), xylenes and kerosene.

Representative typical and more typical independent amounts of additives (if present) and solvent in the fuel composition are given in the table below. For the additives, the concentrations are expressed by weight (of the base fuel) of active additive compounds, i.e. independent of any solvent or diluent. Where more than one additive of each type is present in the fuel composition, the total amount of each type of additive is expressed in the table below.

| | Fuel Composition | |
|---|---|---|
| | Typical amount (ppm, by weight) | More typical amount (ppm, by weight) |
| Anti-oxidant additives | 1000 to 100000 | 2000 to 50000 |
| Detergents | 10 to 2000 | 50 to 300 |
| Friction modifiers and anti-wear additives | 10 to 500 | 25 to 150 |
| Corrosion inhibitors | 0.1 to 100 | 0.5 to 40 |
| Anti-oxidants | 1 to 100 | 10 to 50 |
| Octane improvers | 0 to 20000 | 50 to 10000 |
| Dehazers and demulsifiers | 0.05 to 30 | 0.1 to 10 |
| Anti-static agents | 0.1 to 5 | 0.5 to 2 |
| Other additive components | 0 to 500 | 0 to 200 |
| Solvent | 10 to 3000 | 50 to 1000 |

In some embodiments, the fuel composition comprises or consists of additives and solvents in the typical or more typical amounts recited in the table above.

Fuels for Compression-Ignition Internal Combustion Engines

The anti-oxidant additives may also be used for reducing oxidation in a fuel composition for a compression-ignition internal combustion engine. Diesel fuels (including those containing oxygenates) are typically used in compression-ignition internal combustion engines. Commensurately, the anti-oxidant additives described herein may be used in a diesel fuel composition.

Preferred diesel fuels are those that meet regional fuel specifications, such as EN 590.

The anti-oxidant additives described herein may be combined with a fuel for a compression-ignition internal combustion engine in an amount of up to 1%, preferably from 0.0001% to 0.5%, more preferably from 0.0005% to 0.3%, even more preferably from 0.0008% to 0.2%, and even more preferably still from 0.001% to 0.1%, weight additive/weight base fuel.

In embodiments, the anti-oxidant additives described herein are used in combination with a further anti-oxidant, and preferably a phenolic anti-oxidant such as a hindered phenol.

Lubricants

The anti-oxidant additives may also be used for reducing oxidation in a lubricant.

The lubricant may be an industrial lubricant e.g. for a hydraulic pump, an air or gas compressor, brakes, gears or a turbine. In preferred embodiments, the lubricant is used in an engine, and preferably an internal combustion engine.

The anti-oxidant additives described herein may be combined with the lubricant in an amount of up to 5%, preferably from 0.005% to 3%, more preferably from 0.01% to 2%, even more preferably from 0.05% to 1.5%, and even more preferably still from 0.1% to 1%, weight additive/weight base oil In embodiments, the anti-oxidant additives described herein are used in combination with a further anti-oxidant, and preferably a phenolic anti-oxidant, such as a hindered phenol.

Uses and Methods

The anti-oxidant additives described herein are used in a hydrocarbon fluid.

The hydrocarbon fluid is preferably a fuel, such as a fuel for use in an internal combustion engine.

In preferred embodiments, the fuel is used in a spark-ignition internal combustion engine. Examples of spark-ignition internal combustion engines include direct injection spark-ignition engines and port fuel injection spark-ignition engines. The spark-ignition internal combustion engine may be used in automotive applications, e.g. in a vehicle such as a passenger car.

Examples of suitable direct injection spark-ignition internal combustion engines include boosted direct injection spark-ignition internal combustion engines, e.g. turbocharged boosted direct injection engines and supercharged boosted direct injection engines. Suitable engines include 2.0 L boosted direct injection spark-ignition internal combustion engines. Suitable direct injection engines include those that have side mounted direct injectors and/or centrally mounted direct injectors.

Examples of suitable port fuel injection spark-ignition internal combustion engines include any suitable port fuel injection spark-ignition internal combustion engine including e.g. a BMW 318i engine, a Ford 2.3 L Ranger engine and an MB M111 engine.

In other embodiments, the anti-oxidant additives described herein are used in a fuel for a compression-ignition internal combustion engine.

In other embodiments, the anti-oxidant additives described herein are used in a lubricant, preferably a lubricant for an internal combustion engine.

The anti-oxidant additives described herein may be used in a method for reducing the tendency of a hydrocarbon fluid to oxidise. The efficacy of the anti-oxidant additives described herein as anti-oxidants may be tested according to the following methods:

- ISO 7536:1994 for hydrocarbon fluids which are fuels for use in spark-ignition internal combustion engines;
- ACEA 2016: CEC L-109 for hydrocarbon fluids which are fuels for use in compression-ignition internal combustion engines; and
- ASTM D5483-05(2015) for hydrocarbon fluids which are lubricants.

The anti-oxidant additives described herein may be also be used in a method for protecting a system in which a hydrocarbon fluid is used from the effects of oxidation.

The system may be e.g. a refinery, a storage tank or a transportation tanker. In the case of hydrocarbon fluids that are lubricants, the system may also be any system which requires lubrication, e.g. a system which comprises a hydraulic pump, an air or gas compressor, brakes, gears or a turbine.

However, in preferred embodiments, the system comprises an engine such as an engine in a motorised tool, e.g. a lawn-mower, a power generator or a vehicle, such as an automobile (e.g. a passenger car), a motorcycle or a water-borne vessel (e.g. a ship or a boat). Preferably, the engine is an internal combustion engine, and more preferably a spark-ignition internal combustion engine.

Oxidation can have an effect on the hydrocarbon fluid itself, but can also have an impact on the surfaces in the system.

Thus, in some embodiments, the anti-oxidant additives are used to protect the hydrocarbon fluid in the system from oxidation. For example, the additives may be used to protect the hydrocarbon fluid against polymerisation of unsaturated compounds contained in the hydrocarbon fluid. Polymerisation can lead to thickening of the hydrocarbon fluid, and the formation of gummy residues and solids.

In other embodiments, the anti-oxidant additives are used to protect a surface in the system from the effects of oxidation. The effects of oxidation include degradation of the surface due to oxidation (i.e. oxidation of the surface itself such as with metal surfaces in an engine), and formation of deposits (from oxidation of the hydrocarbon fluid) on the surface.

In preferred embodiments, the anti-oxidant additives are used to protect an engine surface from the effects of oxidation, such as from deposits, e.g. a surface that forms part of an engine component selected from pistons, injectors, inlet valves, turbochargers and combustion chambers.

The methods described herein may comprise the steps of introducing the anti-oxidant into an engine, preferably an internal combustion engine, and/or operating the engine.

The anti-oxidant additive is preferably introduced into the system with the hydrocarbon fluid e.g. as part of a fuel composition (such as a fuel composition described above) or a lubricant composition (such as a lubricant composition described above). For instance, in embodiments in which the system comprises an engine, the method may comprise combining (e.g. by adding, blending or mixing) the anti-oxidant additive with the hydrocarbon fluid (e.g. at a refinery, at an oil terminal, or at a fuel pump) to form a hydrocarbon fluid composition, and introducing the hydrocarbon fluid composition into the engine of the vehicle, e.g. into the fuel tank or the oil sump.

The anti-oxidant additive may also be combined with the hydrocarbon fluid within a vehicle in which the hydrocarbon fluid is used, either by addition of the additive to the fuel stream or oil sump, or by addition of the additive directly into the combustion chamber. In some embodiments, the anti-oxidant additive may be transferred to the fuel from a lubricant into which the additive has been combined, or to the lubricant from a fuel into which the additive has been combined.

It will also be appreciated that the anti-oxidant additive may be added to the hydrocarbon fluid in the form of a precursor compound which, under the combustion conditions encountered in an engine, breaks down to form an anti-oxidant additive as defined herein.

Where the anti-oxidant additives are used in a fuel for a spark-ignition internal combustion engine, they may also be used to increase the octane number of the fuel. Thus, the anti-oxidant additives may be used as a multi-purpose fuel additive.

In some embodiments, the anti-oxidant additives increase the research octane number (RON) or the motor octane number (MON) of the fuel. In preferred embodiments, the anti-oxidant additives increase the RON of the fuel, and more preferably the RON and MON of the fuel. The RON and MON of the fuel may be tested according to ASTM D2699-15a and ASTM D2700-13, respectively.

Since the anti-oxidant additives described herein increase the octane number of a fuel for a spark-ignition internal combustion engine, they may also be used to address abnormal combustion that may arise as a result of a lower than desirable octane number. Thus, the anti-oxidant additives may be used for improving the auto-ignition characteristics of a fuel, e.g. by reducing the propensity of a fuel for at least one of auto-ignition, pre-ignition, knock, mega-knock and super-knock, when used in a spark-ignition internal combustion engine.

The invention will now be described with reference to the following non-limiting examples.

EXAMPLES

Example 1: Preparation of Anti-Oxidant Additives

The following anti-oxidant additives were prepared using standard methods:

OX1

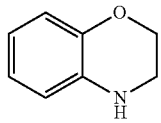

OX2

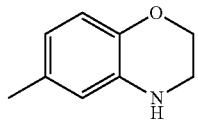

OX3

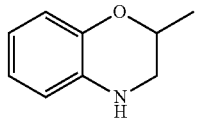

OX4

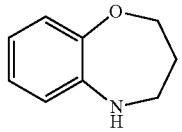

OX5

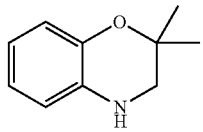

OX6

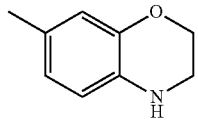

OX7

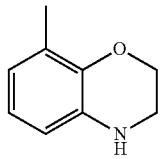

OX8

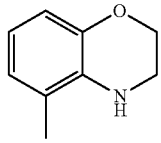

OX9

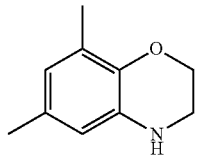

-continued

OX10

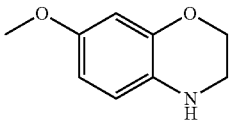

OX11

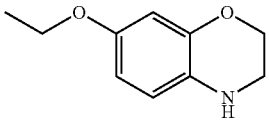

OX12

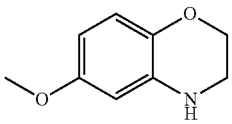

OX13

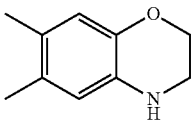

OX14

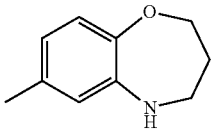

OX15

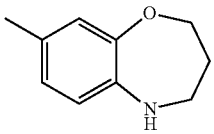

OX16

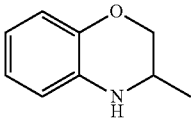

-continued

OX17

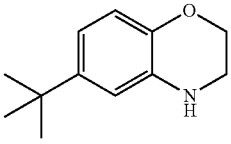

OX18

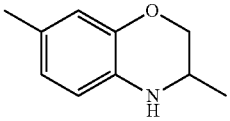

OX19

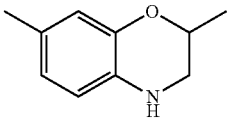

Example 2: Evidence of Anti-Oxidant Activity in Fuels Containing Anti-Oxidant Additives Oxidation of a fuel is known to be caused by free-radicals, and certain classes of anti-oxidant work by quenching these radicals. Free radical quenching is also believed to be implicated in the mechanism by which non-metallic octane-boosting compounds work.

Anti-oxidant activity of additives from Example 1 (OX1, OX2, OX3, OX5, OX6, OX8, OX9, OX12, OX13, OX17 and OX19) was therefore assessed by measuring the effect of the additives on the octane number of two different base fuels for a spark-ignition internal combustion engine.

The additives were added to the fuels at a relatively low treat rate of 0.67% weight additive/weight base fuel, equivalent to a treat rate of 5 g additive/litre of fuel. The first fuel was an E0 gasoline base fuel. The second fuel was an E10 gasoline base fuel. The RON and MON of the base fuels, as well as the blends of base fuel and anti-oxidant additive, were determined according to ASTM D2699 and ASTM D2700, respectively.

The following table shows the RON and MON of the fuel and the blends of fuel and anti-oxidant additive, as well as the change in the RON and MON that was brought about by using the anti-oxidant additives:

| | E0 base fuel | | | | E10 base fuel | | | |
|---|---|---|---|---|---|---|---|---|
| Additive | RON | MON | ΔRON | ΔMON | RON | MON | ΔRON | ΔMON |
| — | 95.4 | 86.0 | n/a | n/a | 95.4 | 85.2 | n/a | n/a |
| OX1 | — | — | — | — | 97.3 | 86.3 | 1.9 | 1.1 |
| OX2 | 97.7 | 87.7 | 2.3 | 1.7 | 97.8 | 86.5 | 2.4 | 1.3 |
| OX3 | 97.0 | 86.7 | 1.6 | 0.7 | 97.1 | 85.5 | 1.7 | 0.3 |
| OX5 | 97.0 | 86.5 | 1.6 | 0.5 | 97.1 | 85.5 | 1.7 | 0.3 |
| OX6 | 98.0 | 87.7 | 2.6 | 1.7 | 98.0 | 86.8 | 2.6 | 1.6 |
| OX8 | 96.9 | 86.1 | 1.5 | 0.1 | 96.9 | 85.7 | 1.5 | 0.5 |
| OX9 | 97.6 | 86.9 | 2.2 | 0.9 | 97.6 | 86.5 | 2.2 | 1.3 |
| OX12 | 97.4 | 86.3 | 2.0 | 0.3 | 97.3 | 86.1 | 1.9 | 0.9 |
| OX13 | 97.9 | 86.5 | 2.5 | 0.5 | 97.7 | 86.1 | 2.3 | 0.9 |
| OX17 | 97.5 | 86.4 | 2.1 | 0.4 | 97.4 | 86.4 | 2.0 | 1.2 |
| OX19 | 97.4 | 86.1 | 2.0 | 0.1 | 97.6 | 85.9 | 2.2 | 0.7 |

It can be seen that the anti-oxidant additives may be used to increase the RON of an ethanol-free and an ethanol-containing fuel for a spark-ignition internal combustion engine. This provides strong evidence of the efficacy of the additives as anti-oxidants.

Further additives from Example 1 (OX4, OX7, OX10, OX11, OX14, OX15, OX16 and OX18) were tested in the E0 gasoline base fuel and the E10 gasoline base fuel. Each of the additives increased the RON of both fuels, aside from OX7 where there was insufficient additive to carry out analysis with the ethanol-containing fuel.

Example 3: Efficacy at Different Anti-Oxidant Additive Treat Rates

The effect of an anti-oxidant additive from Example 1 (OX6) on the octane number of three different base fuels for a spark-ignition internal combustion engine was measured over a range of treat rates (% weight additive/weight base fuel).

The first and second fuels were E0 gasoline base fuels. The third fuel was an E10 gasoline base fuel. As before, the RON and MON of the base fuels, as well as the blends of base fuel and anti-oxidant additive, were determined according to ASTM D2699 and ASTM D2700, respectively.

The following table shows the RON and MON of the fuels and the blends of fuel and anti-oxidant additive, as well as the change in the RON and MON that was brought about by using the anti-oxidant additives:

| | Additive treat rate | Octane number | | | |
|---|---|---|---|---|---|
| | (% w/w) | RON | MON | ΔRON | ΔMON |
| E0 90 RON | 0.00 | 89.9 | 82.8 | 0.0 | 0.0 |
| | 0.20 | 91.5 | 83.5 | 1.6 | 0.7 |
| | 0.30 | 92.0 | 83.6 | 2.1 | 0.8 |
| | 0.40 | 92.5 | 83.8 | 2.6 | 1.0 |
| | 0.50 | 92.9 | 83.8 | 3.0 | 1.0 |
| | 0.67 | 93.6 | 84.2 | 3.7 | 1.4 |
| | 1.01 | 94.7 | 85.0 | 4.8 | 2.2 |
| | 1.34 | 95.9 | 85.4 | 6.0 | 2.6 |
| | 10.00 | 104.5 | 87.9 | 14.6 | 5.1 |
| E0 95 RON | 0.00 | 95.2 | 85.6 | 0.0 | 0.0 |
| | 0.10 | 95.9 | 85.8 | 0.7 | 0.2 |
| | 0.20 | 96.4 | 86.3 | 1.2 | 0.7 |
| | 0.30 | 96.6 | 86.8 | 1.4 | 1.2 |
| | 0.40 | 97.1 | 86.6 | 1.9 | 1.0 |
| | 0.50 | 97.3 | 87.0 | 2.1 | 1.4 |
| | 0.60 | 97.5 | 86.8 | 2.3 | 1.2 |
| | 0.70 | 97.8 | 86.8 | 2.6 | 1.2 |
| | 0.80 | 98.0 | 87.3 | 2.8 | 1.7 |
| | 0.90 | 98.5 | 86.8 | 3.3 | 1.2 |
| | 1.00 | 98.7 | 86.9 | 3.5 | 1.3 |
| | 10.00 | 105.7 | 88.7 | 10.5 | 3.1 |
| E10 95 RON | 0.00 | 95.4 | 85.1 | 0.0 | 0.0 |
| | 0.10 | 95.9 | 85.2 | 0.5 | 0.1 |
| | 0.20 | 96.3 | 86.3 | 0.9 | 1.2 |
| | 0.30 | 96.8 | 86.3 | 1.4 | 1.2 |
| | 0.40 | 96.9 | 85.8 | 1.5 | 0.7 |
| | 0.50 | 97.3 | 85.9 | 1.9 | 0.8 |
| | 0.60 | 97.4 | 85.9 | 2.0 | 0.8 |
| | 0.70 | 97.9 | 86.0 | 2.5 | 0.9 |
| | 0.80 | 98.2 | 86.8 | 2.8 | 1.7 |
| | 0.90 | 98.7 | 86.3 | 3.3 | 1.2 |
| | 1.00 | 98.8 | 86.5 | 3.4 | 1.4 |
| | 10.00 | 105.1 | 87.8 | 9.7 | 2.7 |

Figure 1B:
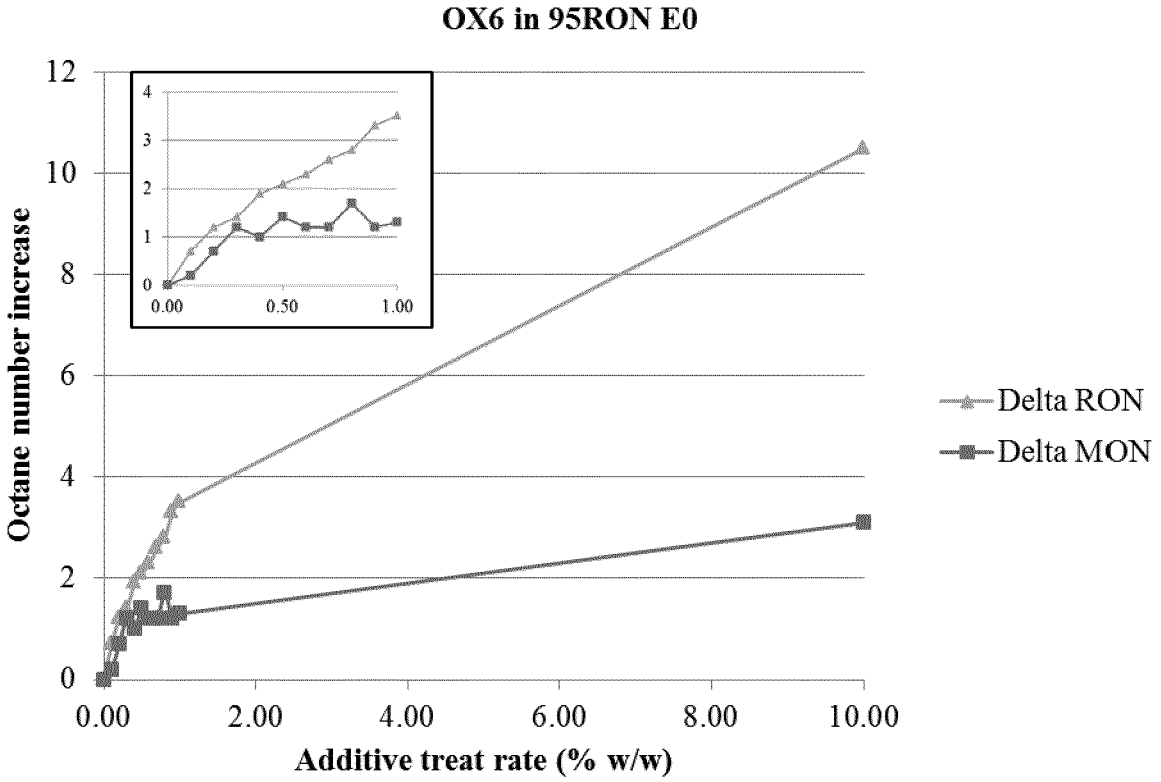
Figure 1C:
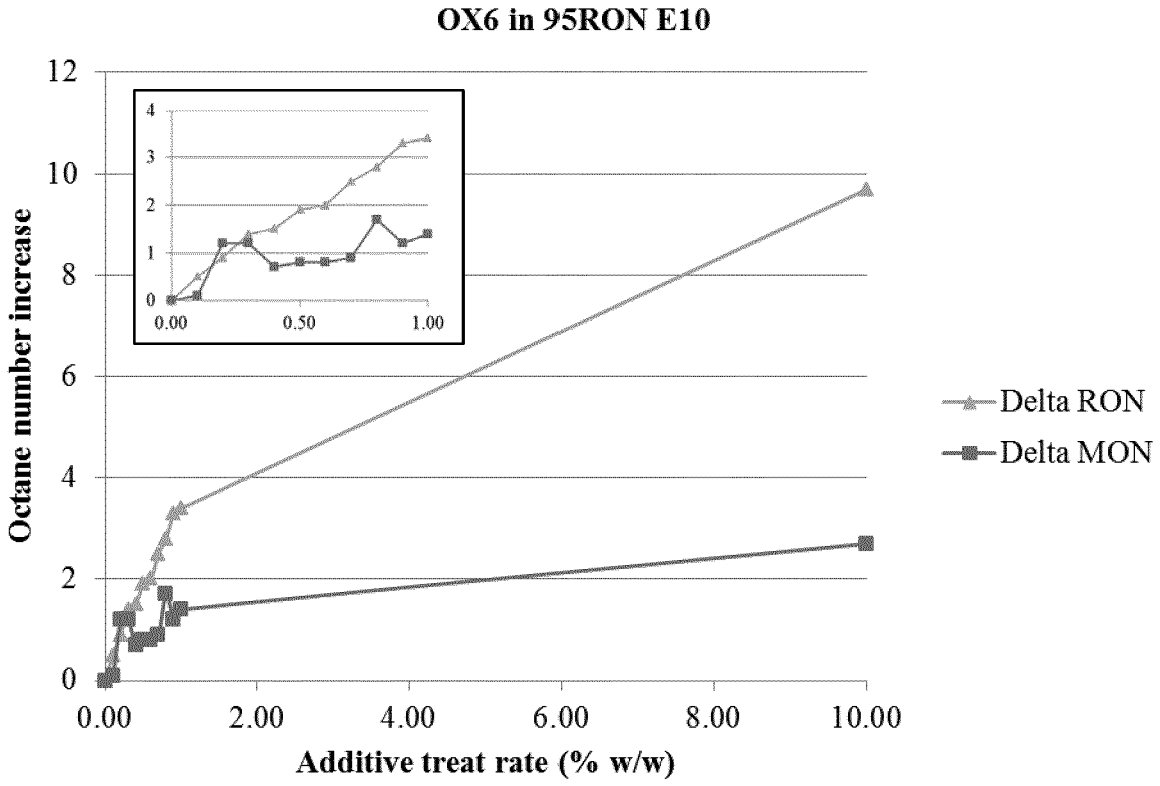

Graphs of the effect of the anti-oxidant additive on the RON and MON of the three fuels are shown in FIGS. 1*a-c*. It can be seen that the anti-oxidant additive had a significant effect on the octane numbers of each of the fuels, even at very low treat rates. This suggests that the additives would also be effective as anti-oxidants at low treat rates.

Example 4: Comparison of Anti-Oxidant Additive with N-Methyl Aniline

The effect of anti-oxidant additives from Example 1 (OX2 and OX6) was compared with the effect of N-methyl aniline on the octane number of two different base fuels for a spark-ignition internal combustion engine over a range of treat rates (% weight additive/weight base fuel).

The first fuel was an E0 gasoline base fuel. The second fuel was an E10 gasoline base fuel. As before, the RON and MON of the base fuels, as well as the blends of base fuel and anti-oxidant additive, were determined according to ASTM D2699 and ASTM D2700, respectively.

Figure 2A:
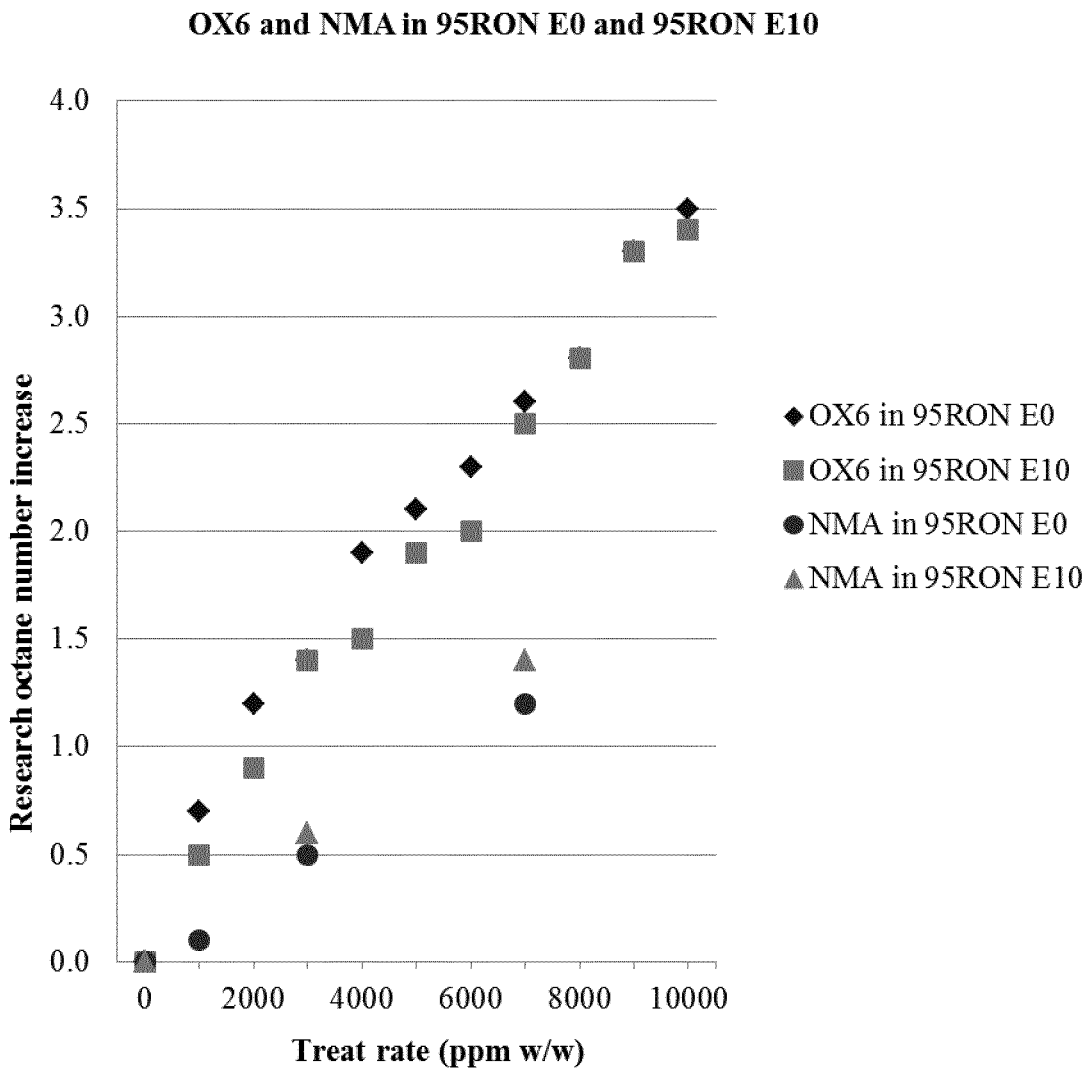
FIGS. 2*a-c* show graphs comparing the change in octane number (both RON and MON) of fuels when treated with anti-oxidant additives described herein and N-methyl aniline. Specifically.

A graph of the change in octane number of the E0 and E10 fuels against treat rate of N-methyl aniline and an anti-oxidant additive (OX6) is shown in FIG. 2*a*. The treat rates are typical of those used in a fuel. It can be seen from the graph that the performance of the anti-oxidant additives described herein is significantly better than that of N-methyl aniline across the treat rates.

Figure 2B:
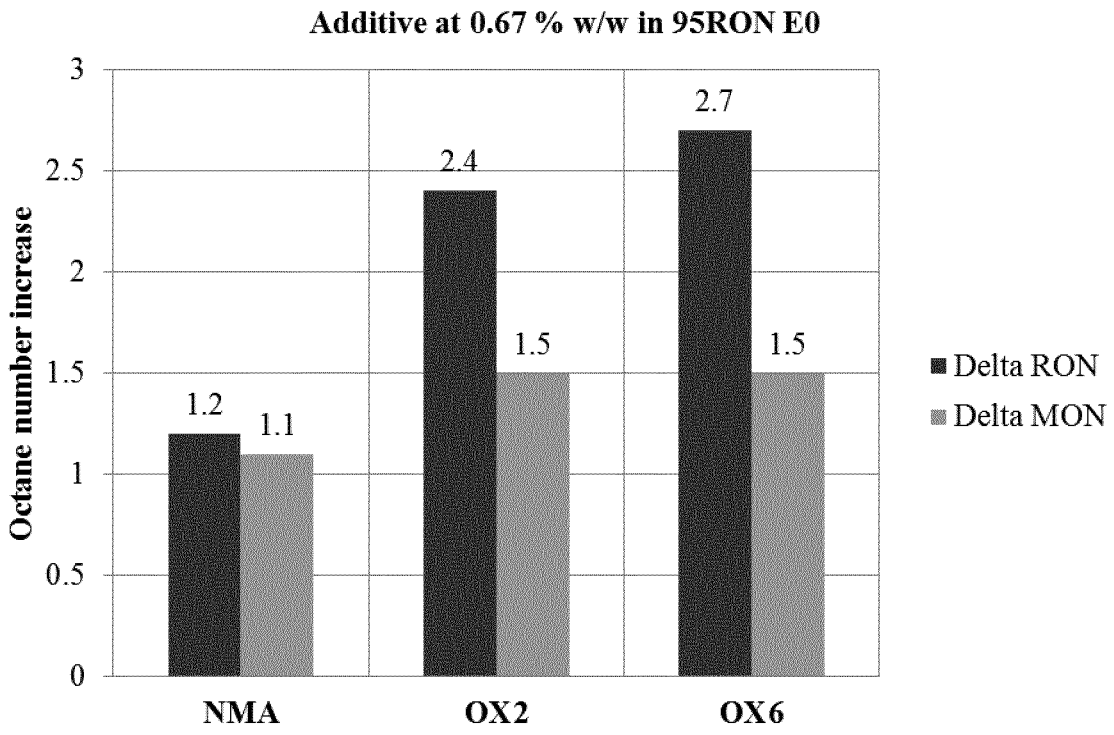
Figure 2C:
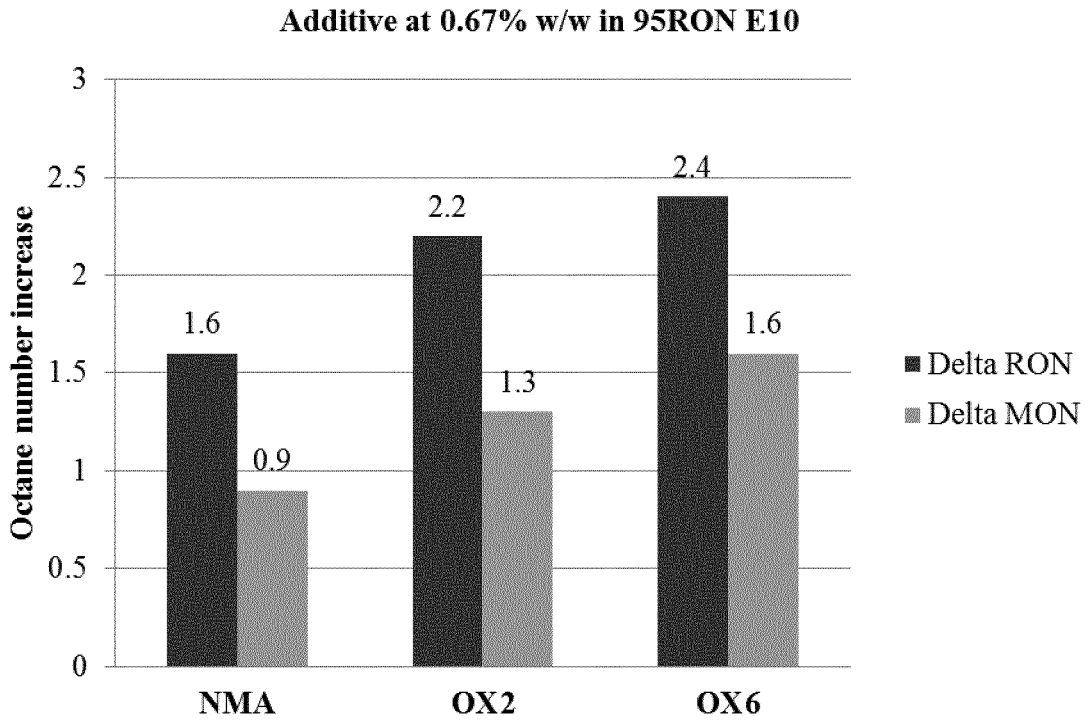

A comparison of the effect of two anti-oxidant additives (OX2 and OX6) and N-methyl aniline on the octane number of the E0 and E10 fuels at a treat rate of 0.67% w/w is shown in FIGS. 2*b* and 2*c*. It can be seen from the graph that the performance of anti-oxidant additives described herein is significantly superior to that of N-methyl aniline. Specifically, an improvement of about 35% to about 50% is observed for the RON, and an improvement of about 45% to about 75% is observed for the MON.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope and spirit of this invention.

The invention claimed is:

1. A method for reducing the tendency of a hydrocarbon fluid to oxidise, said method comprising combining an additive with the hydrocarbon fluid, wherein the additive has the formula:

(a)

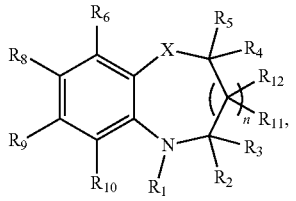

(b)

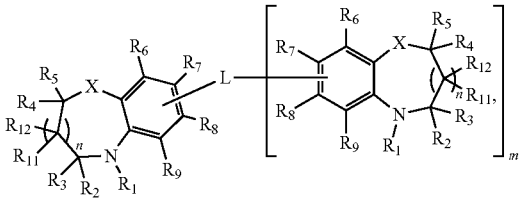

, or (c)

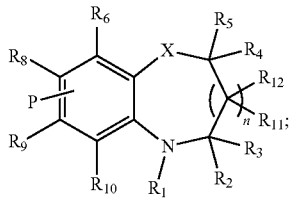

where: $R_1$ is hydrogen;

$R_2$, $R_3$, $R_4$, $R_5$, $R_{11}$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups;

n is 0 or 1;

L is a linking group;

m is 1, 2 or 3; and

P is a polymer-containing group or a group derived from a fatty acid, wherein at least one of $R_2$, $R_3$, $R_4$, $R_5$, $R_6$, $R_7$, $R_8$, $R_9$, $R_{11}$ and $R_{12}$ is selected from a group other than hydrogen, with the proviso that, where the additive has formula (b) or (c), one of $R_6$, $R_7$, $R_8$ and $R_9$ on each 6-membered aromatic ring is substituted with the linking group L or the polymer-containing group P, respectively.

2. A method according to claim 1, wherein $R_2$, $R_3$, $R_4$, $R_5$, $R_{11}$ and $R_{12}$ are each independently selected from hydrogen and alkyl groups.

3. A method according to claim 1, wherein $R_6$, $R_7$, $R_8$ and $R_9$ are each independently selected from hydrogen, alkyl and alkoxy groups.

4. A method according to claim 1, wherein no more than five of $R_2$, $R_3$, $R_4$, $R_5$, $R_6$, $R_7$, $R_8$, $R_9$, $R_{11}$ and $R_{12}$ are selected from a group other than hydrogen.

5. A method according to claim 1, wherein at least one of $R_2$ and $R_3$ is hydrogen.

6. A method according to claim 1, wherein at least one of $R_4$, $R_5$, $R_7$ and $R_8$ is selected from methyl, ethyl, propyl and butyl groups and the remainder of $R_2$, $R_3$, $R_4$, $R_5$, $R_6$, $R_7$, $R_8$, $R_9$, $R_{11}$ and $R_{12}$ are hydrogen.

7. A method according to claim 6, wherein at least one of $R_4$, $R_5$, $R_7$ and $R_8$ is a methyl group and the remainder of $R_2$, $R_3$, $R_4$, $R_5$, $R_6$, $R_7$, $R_8$, $R_9$, $R_{11}$ and $R_{12}$ are hydrogen.

8. A method according to claim 1, wherein X is —O— or —$NR_{10}$—, where $R_{10}$ is selected from hydrogen, methyl, ethyl, propyl and butyl groups.

9. A method according to claim 1, wherein n is 0.

10. A method according to claim 1, wherein m is 1.

11. A method according to claim 10, wherein:

L is selected from —$R_{13}$—, —O—$R_{13}$—O—, —O—$(R_{14}O)_p$— and —OC(O)— $R_{13}$—C(O)O—, where:

$R_{13}$ is selected from alkanediyl and alkenediyl groups;

$R_{14}$ is selected from alkanediyl groups; and p is from 1 to 30.

12. A method according to claim 1, wherein m is 2 or 3.

13. A method according to claim 12, wherein:

L is selected from —O—$R_{15}$—$CH_{3-m}(R_{15}$—O—$)_m$ and —OC(O)—$R_{15}$—$CH_{3-m}(R_{15}$—C(O)O—$)_m$, where $R_{15}$ is selected from alkanediyl and alkenediyl groups.

14. A method according to claim 1, wherein P is a polymer-containing group having the structure:

-A-B-C where: A may be present or absent, and is selected from —O—,—$OR_{16}$— and —$R_{16}$—, -, where $R_{16}$ is selected from alkanediyl and alkenediyl groups;

B is a polyolefin or a polyether; and

C is selected from alkyl and alkoxy groups.

15. A method according to claim 1, wherein P is a group derived from a fatty acid having the structure —OC(O)—$R_{15}$, where $R_{15}$ is a $C_{1-26}$ hydrocarbon chain.

16. A method according to claim 1, wherein the additive has the formula:

(a)

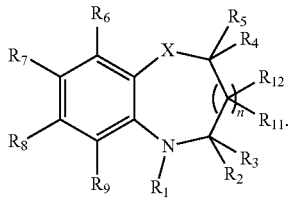

17. A method according to claim 16, wherein the additive is selected from:

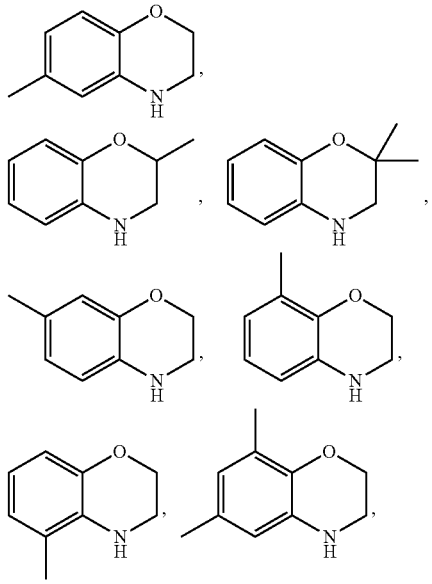

-continued

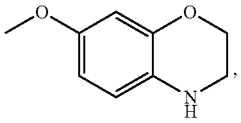

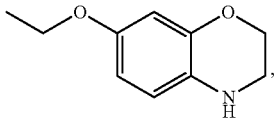

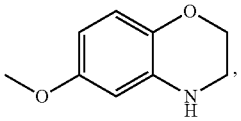

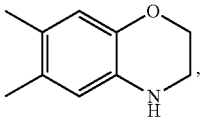

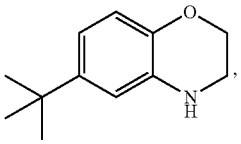

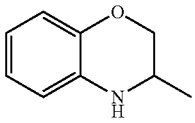

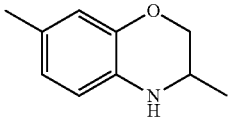

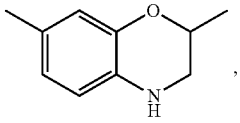

and

-continued

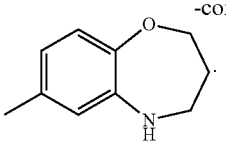

18. A method according to claim 1, wherein the hydrocarbon fluid is a fuel, and wherein the additive is combined with the fuel in an amount of up to 1% weight additive/weight base fuel.

19. A method according to claim 1, wherein the hydrocarbon fluid is a lubricant, and wherein the additive is combined with the lubricant in an amount of up to 5% weight additive/weight base oil.

20. A method according to claim 1, wherein the hydrocarbon fluid contains a further anti-oxidant.

21. A method for protecting a system in which a hydrocarbon fluid is used from the effects of oxidation, said method comprising combining an additive as defined in claim 1 with the hydrocarbon fluid.

22. A method according to claim 21, wherein the system comprises an internal combustion engine.

23. A method according to claim 1, wherein the additive and the hydrocarbon fluid are combined in a spark-ignition internal combustion engine.

* * * * *